US006431080B1

(12) United States Patent
Eisendle et al.

(10) Patent No.: US 6,431,080 B1
(45) Date of Patent: Aug. 13, 2002

(54) ACCELERATOR AND DECELERATOR SLIDING BLOCK, IN PARTICULAR FOR TRANSPORT SYSTEM VEHICLES, AND CONVEYOR ASSOCIABLE TO SAID SLIDING BLOCK

(75) Inventors: Peter Eisendle, Racines Di Fuori; Ferruccio Levi, Cologno Monzese, both of (IT)

(73) Assignee: Leitner S.p.A, Vipiteno (IT)

( * ) Notice: Subject to any disclaimer, the term of this patent is extended or adjusted under 35 U.S.C. 154(b) by 0 days.

(21) Appl. No.: 09/634,631

(22) Filed: Aug. 8, 2000

(30) Foreign Application Priority Data

Apr. 12, 2000 (IT) ..... MI200A801

(51) Int. Cl.[7] ..... B61B 12/10
(52) U.S. Cl. ..... 104/178
(58) Field of Search ..... 104/89, 91, 93, 104/178; 105/141, 148, 160

(56) References Cited

U.S. PATENT DOCUMENTS 5,121,695 A * 6/1992 Feuz ..... 104/178
5,806,434 A * 9/1998 Enderlein et al. ..... 104/88.06
6,003,443 A * 12/1999 Kubsik et al. ..... 104/172.4

* cited by examiner

*Primary Examiner*—S. Joseph Morano
*Assistant Examiner*—Robert J. McCarry, Jr.
(74) *Attorney, Agent, or Firm*—Oblon, Spivak, McClelland, Maier & Neustadt, P.C.

(57) ABSTRACT

An accelerator and decelerator sliding block (30), in particular for transport system vehicles, comprising a first plane portion (40) longitudinally elongated, operatively associable to a roller conveyor (11) for accelerating or decelerating a vehicle, and a second portion (38) which extends longitudinally for a longer portion than the first portion (40); the roller conveyor (11) comprises a beam (18) which carries a plurality of axes (20), each carrying in turn a roller (22, 24) associable to the sliding block (30) so that first rollers (22) are arranged at free ends of the conveyor (11) and are arranged at a greater distance than that between successive second rollers (24).

15 Claims, 4 Drawing Sheets

ACCELERATOR AND DECELERATOR SLIDING BLOCK, IN PARTICULAR FOR TRANSPORT SYSTEM VEHICLES, AND CONVEYOR ASSOCIABLE TO SAID SLIDING BLOCK

The present invention relates to an accelerator and decelerator sliding block, in particular for transport system vehicles, and to a conveyor associable to said sliding block.

In the following description, by way of explicative but not limitative example, reference shall be made to the application of the present invention to vehicles of a cableway transport system, in particular to two-cable systems. Nevertheless, it is evident that the same teachings are applicable to any different type of transport system and relevant automatic conveyor, such as for example a multi-speed pallet conveyor. As known, two-cable cableway systems comprise fixed structures which support a carrying cable, which in turn supports a plurality of vehicles of the system. Moreover, the cableway system comprises a traction cable, which can be actuated in translation through a winch, to which the vehicles are coupled through a clamping vice so as to be towed.

The vehicles comprise a telpher, wherein the passengers are housed, from which a support arm, bent and hinged to a trolley, starts.

The trolley carries a clamping vice at one of its lower portions, whereas at an upper portion, the same trolley carries a plurality of projecting wheels, which are associated to the carrying cable. Finally, on top of the trolley there is placed a sliding block, which allows accelerating and decelerating the vehicle when entering into the station or exiting from the same. Said sliding block co-operates with a roller conveyor, which decelerates the vehicle from the speed of synchronism with the traction cable until it stops, whereas another portion of the conveyor accelerates the vehicle so as to bring it back to the speed of synchronism with the traction cable.

Nevertheless, in traditional transport systems, and in particular in cableway systems, the conveyors must necessarily have a very high number of rollers; in fact, the accelerations and decelerations are imparted to the vehicle by the rollers, so that they are necessarily jerkily or stepwise, with a consequent repercussions on the passengers' comfort.

For the purpose of limiting the entity of said projecting portions, the rollers are arranged very close to each other, and each has a speed not very different from that of the adjoining rollers; in this case, the sliding block exhibits a limited size in the advancement direction of the vehicle, as it must operate only with a single roller at a time and, by limiting the speed difference between consecutive rollers, the irregularities of acceleration are contained within acceptable values.

Nevertheless, the high number of rollers of the conveyor affects the high purchase and maintenance costs of the system, and implies several problems of reliability and safety.

Thus, object of the present invention is that of solving the technical disadvantages reported by realising an accelerator and decelerator sliding block, in particular for transport system vehicles, and a conveyor associable to said sliding block, which should allow accelerating and decelerating a transport system vehicle, limiting acceleration discontinuities during the motion.

Another object of the invention is that of realising a sliding block and a conveyor for transport system vehicles at relatively moderate costs, with respect to the prior art, under the attained advantages, and which should require a limited maintenance.

Last but not least, a further object of the invention is that of realising an accelerator and decelerator sliding block, in particular for cableway transport system vehicles, and a conveyor associable to said sliding block, which should be substantially simple, safe and reliable.

These and other objects according to the present invention are attained by realising an accelerator and decelerator sliding block, in particular for transport system vehicles, according to claim 1.

Advantageously, said sliding block operates in association with a conveyor according to claim 7. Moreover, further features of the present invention are defined in further claims.

Advantageously, the sliding block and the conveyor, according to the present invention, make the entire transport system significantly less expensive and more reliable with respect to traditional systems; in fact, the conveyor exhibits a considerably smaller number of rollers with respect to those needed when using traditional sliding blocks, and as a consequence, the reduced number of rollers implies a reduced number of motion drive elements, such as belts and pulleys, to be installed with respect to the prior art. Moreover, the reduction of the number of rollers implies an important improvement of the mechanical efficiency of the conveyor.

Further features and advantages of an accelerator and decelerator sliding block, in particular for transport system vehicles, and of a conveyor associable to said sliding block, according to the present invention, will appear more clearly from the following exemplifying and non-limiting description, made with reference to the attached schematic drawings. In such drawings.

Figure 1:
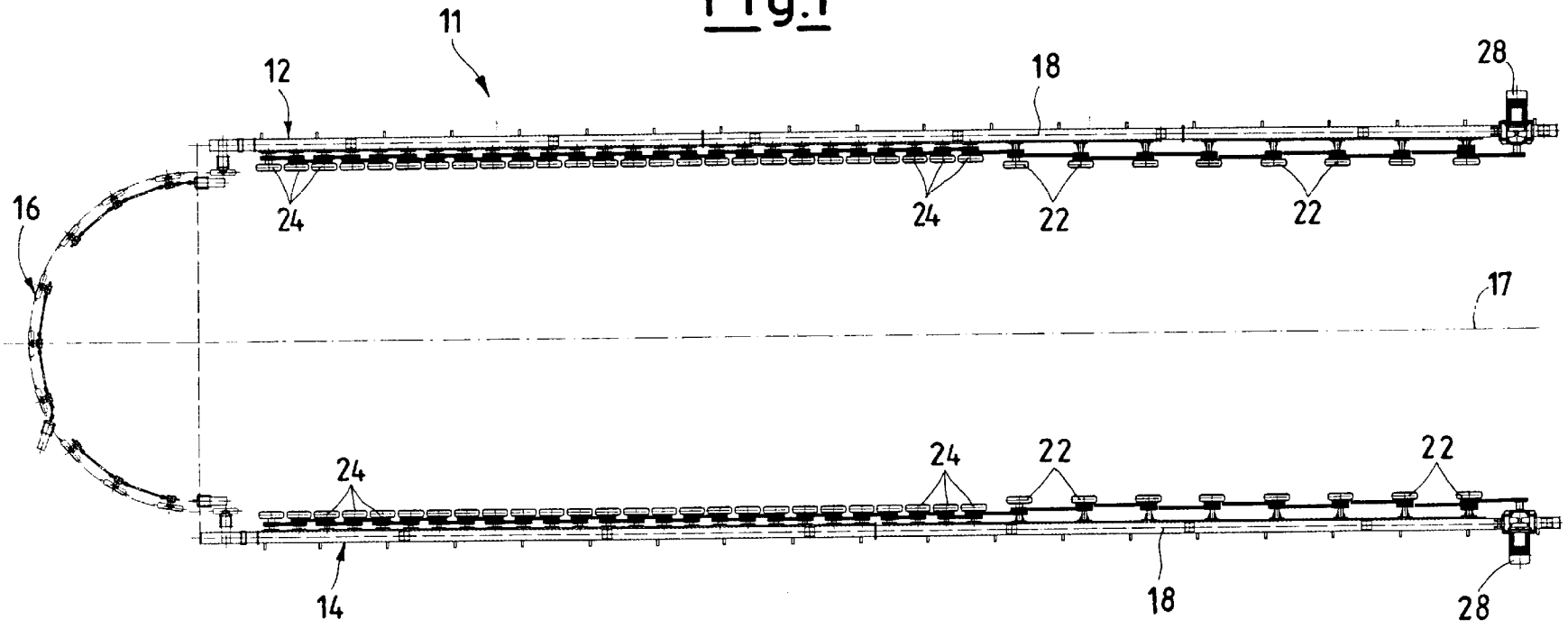
FIG. 1 shows a schematic plan view of a conveyor according to the invention.
Figure 2:
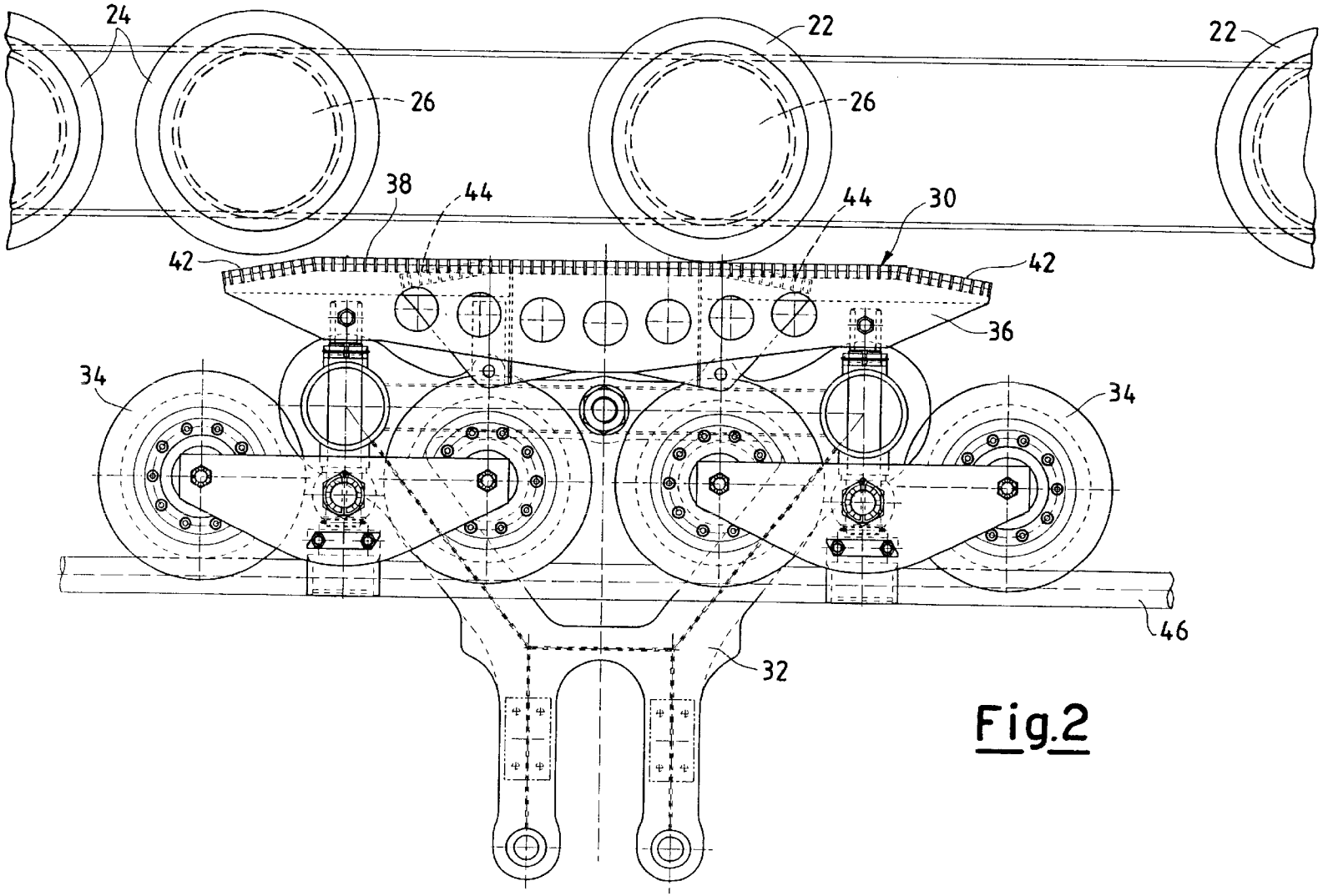
FIG. 2 shows a side elevation view of a trolley and relevant sliding block of a vehicle of the system, according to the present invention, associated to a portion of the conveyor of FIG. 1.
Figure 3:
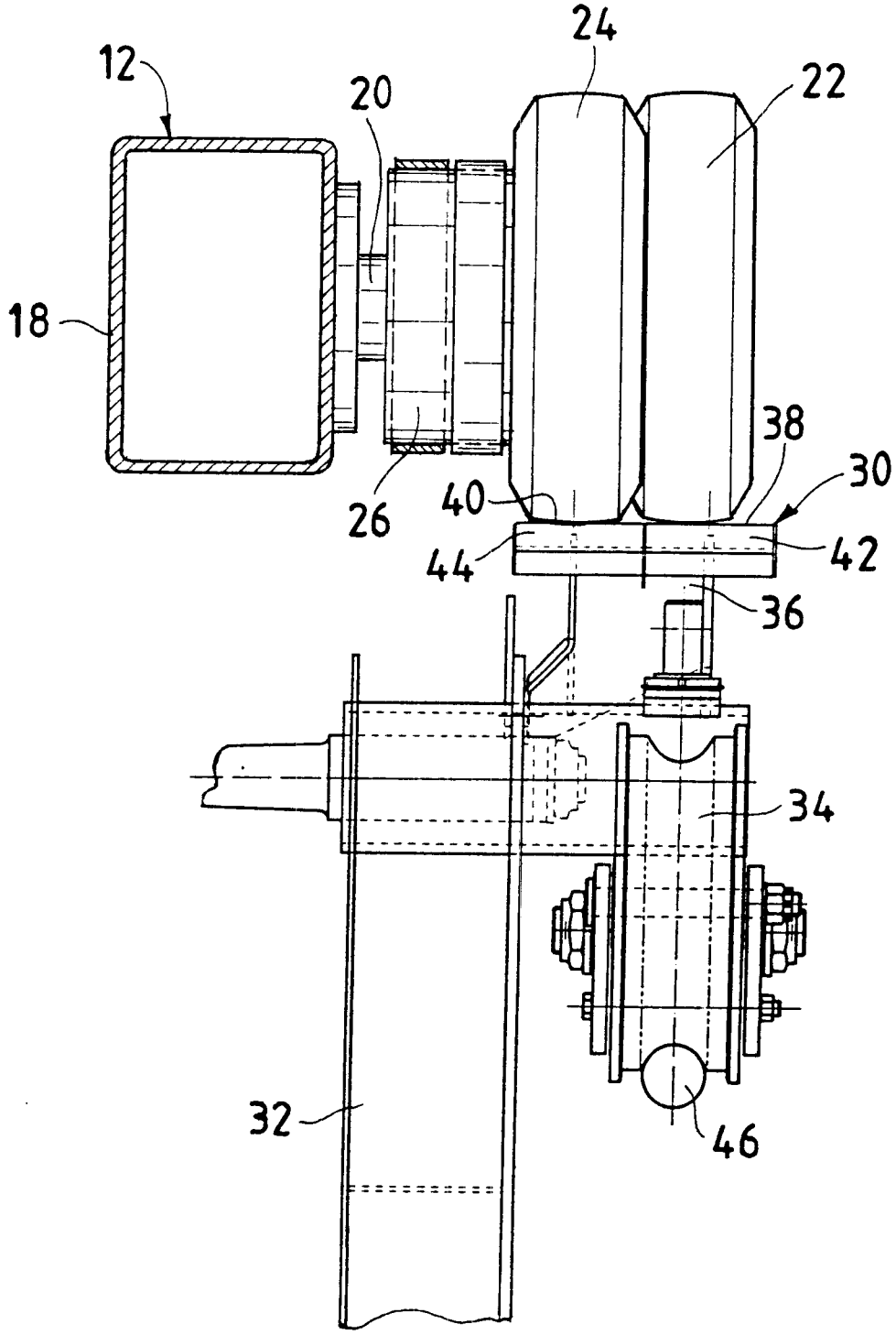
FIG. 3 shows a front elevation and partly sectioned view of the assembly shown in FIG. 2.
Figure 4:
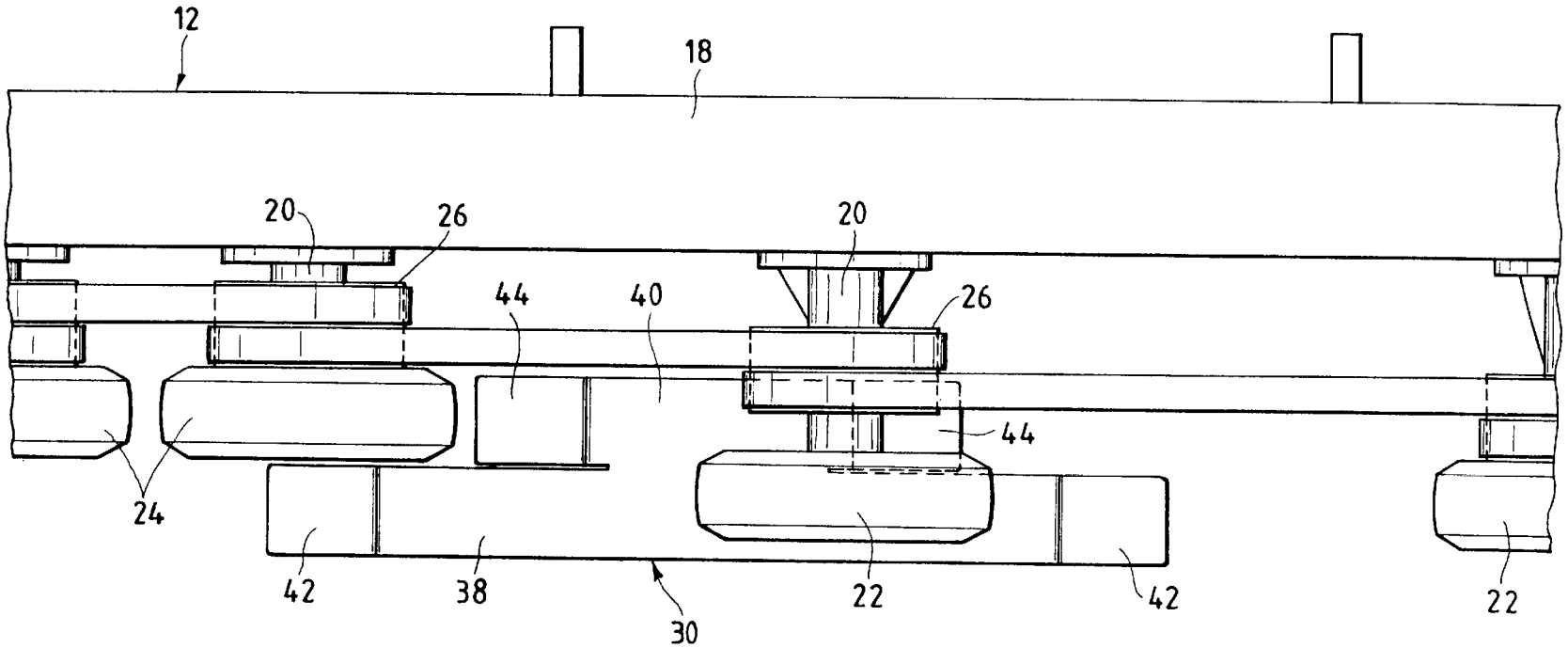
FIG. 4 shows a top plan view of the assembly of FIG. 2, where the trolley is not shown for convenience of illustration.

With reference to the figures mentioned, there is shown a roller conveyor, indicated as a whole with reference numeral 11. Conveyor 11 comprises a first guide portion 12, adapted to decelerate a vehicle from a first value of speed of synchronism of the same with a traction cable of the system down to a predetermined lower value, and a second guide portion 14, which accelerates the vehicle from a second speed value, lower than the above predetermined value, to the vehicle speed of synchronism with the traction cable of the system. Between the guide portions 12, 14, conveyor 11 exhibits a further portion 16, at which the vehicle is kept in movement at a very slow speed, or even at a standstill, so that the passengers can get on and off the vehicle and, afterwards, the vehicle can be restarted and driven up to the above second speed value.

Conveyor 11 is functionally symmetrical with respect to a longitudinal axis 17, and each of its portions 12, 14 comprises a beam 18, which supports a plurality of projecting axes 20, which in turn support first rollers 22 and second rollers 24, all idle on their axis 20.

Each axis 20 is further fastened to two pulleys 26, having different diameter, integral with one another and idle on axis 20, and rigidly connected to the respective roller 22, 24. The use of driving belts can be provided onto pulleys 26, which connect them to a geared motor device 28.

In practice, each pair of consecutive rollers 22, 24 is connected through a driving belt, which is wound on the corresponding pulley 26.

Geared motor 28 drives all rollers 22, 24 so as to make them rotate, with decreasing speed values, starting from roller 22, arranged at the entrance to the station, towards portion 16 of conveyor 11, known in itself and not described in detail for convenience of discussion.

In the particular case of a cableway transport system, the driving by means of the geared motor is not usually used; as a rule, the conveyor is driven and moved directly by a series of rollers integral with the cable, or by a pulley moved by the cable.

Rollers 22, which are arranged at the entrance to the station, are projecting, and they are more spaced from one another with respect to rollers 24, which on the other hand are adjacent to portion 16 of conveyor 11. Portion 14 is similar and symmetrical to portion 12, with the obvious differences due to the fact that, in this case, the vehicle arrives at low speed exiting from portion 16 of conveyor 11, and it is accelerated up to the speed of synchronism with the traction cable. Of course, the succession of the conveyor portions, respectively, with closer and more spaced rollers must be intended as an exemplificative and not limitative embodiment of the present invention.

Usually, for example in the passage through an intermediate station or in an automated warehouse, the sections can be interchanged in different ways according to the requirements; however, in general, rollers will be used in closer relationship in portions where the vehicle undergoes an acceleration or deceleration starting from a very low speed, and in a more spaced relationship in all the other cases.

Conveyor 11, according to the present invention, operates in association with a sliding block 30, which is mounted on top of a trolley 32. Trolley 32 supports four projecting wheels 34 and, moreover, it carries an integral plate-shaped support 36 of the actual sliding block 30.

In preferred and not limitative embodiments of the invention, the sliding block 30 comprises two sided portions 38, 40 integral with one another; portion 38 is plane and longitudinally elongated, with two opposed chamfered ends 42, which constitute a receiving element for rollers 22, whereas portion 40, plane and longitudinally elongated as well, exhibits opposed chamfered ends 44, adapted to drive rollers 24.

In particular, portion 38 extends longitudinally for a longer portion with respect to a portion 40 placed at its side, and the length of each portion 38, 40 is such that when a roller 22 or 24 is departing from one of the chamfered ends, respectively 42 or 44, the successive roller 22 or 24 engages the other chamfered end 42 or 44.

In this case, as well, the fact that rollers 22, with greater pitch, be mounted with a greater projecting portion with respect to rollers 24, is a simple constructive possibility; of course, it is also possible to provide for exactly the opposite embodiment, without impairing in any way the overall operation of the system.

The operation of the accelerator and decelerator sliding block, in particular for transport system vehicles, according to the present invention, is substantially as follows.

In a first step, the vehicle approaches the station with wheels 34 of trolley 32 guided by the carrying cable 46. At each station, sliding block 30 couples with conveyor 11 and, in the particular case of a cableway transport system, a clamping vice of the vehicle opens, releasing itself from the traction cable.

At first, portion 38 of sliding block 30 comes into contact in succession with rollers 22, and it is decelerated by them. Since the vehicle speed at rollers 22 is quite high (in fact, it is close to that of the traction cable, which can have values of about 6 m/s), the acceleration being equal, the difference of speed between two adjacent rollers 22, along portion 12 of conveyor 11, is quite moderate, and thus rollers 22 can be provided as relatively spaced from one another.

On the contrary, in a successive portion, at low speed, rollers 24 must necessarily by installed substantially close to one another, since acceleration being equal, the difference of speed between two adjacent rollers 24 would become excessive.

In any case, the portions of conveyor 11 respectively comprising rollers 22 and 24 are functionally symmetrical, and the subsequent restarts of the vehicles from each station are carried out with operations totally similar to those described in deceleration step.

In particular, the vehicle arriving from portion 16 of conveyor 11 is at first accelerated due to the action of rollers 24 on portion 42 of the sliding block 30, and afterwards, due to the action of rollers 22, on portion 38 of the sliding block. At this point, in case of a cableway system, the vehicle—brought to the speed of synchronism—clamps to the traction cable again and continues its run on the system.

As clearly highlighted by the figures, when a roller 22, 24 is departing from one of the chamfered ends 38, 40 of the sliding block 30, and it is on a chamfered end 40, 42, in the same instant the successive roller 22, 24 is already engaging the other chamfered end 42, 44 of the same sliding block 30.

Similarly, when the last roller 22 departs from the chamfered end 42 of portion 38 of the sliding block, the first roller 24 engages on the chamfered end 44 of portion 40 of the sliding block 30; in this way, the acceleration variations are limited and the comfort inside the vehicle is improved.

In further preferred embodiments of the invention, the three rollers 22 arranged at the ends in entrance to portion 12 and at the end in exit from portion 14 of conveyor 11 exhibit a speed synchronised with the speed of the traction cable of the cableway transport system, whereas the three rollers 24 arranged at the end in exit of portion 12 and at the end in entrance of portion 14 exhibit a speed synchronised with that of portion 16 of conveyor 11.

On the other hand, rollers 22 and 24, which are comprised between the end rollers, have a decreasing speed for portion 12 and increasing for portion 14. From the description made above, the features of the sliding block for transport system vehicles, in particular of the cableway type and of the relevant associated conveyor, object of the present invention, are clear, and their advantages are clear as well.

Nevertheless, it is evident that several variants can be made to the sliding block and to the relevant conveyor without departing from the novelty principles of the inventive idea, and it is also clear that, in the practical embodiment of the invention, materials, shapes and sizes of the illustrated details can be of any type according to the requirements, and the same can be replaced with other technical equivalencies.

What is claimed is:

1. An accelerator and decelerator sliding block for transport system vehicles, comprising at least one first flat portion longitudinally elongated, operatively associable to a roller conveyor, for decelerating or accelerating said vehicle, wherein said sliding block comprises at least one second plane portion, longitudinally elongated and operatively associable to the roller conveyor as well, which extends for a different length with respect to said first portion.

2. The sliding block according to claim 1, wherein said second portion is placed side by side to said first portion.

3. The sliding block according to claim 2, wherein said sliding block is symmetrical with respect to a center traversal axis.

4. The sliding block according to claim 1, wherein said first portion exhibits, at longitudinal opposed ends, junction chamfers which constitute a receiving element for successive rollers of said conveyor.

5. The sliding block according to claim 1, wherein said second portion exhibits, at longitudinal opposed ends, junction chamfers which constitute a receiving element for successive rollers of said conveyor.

6. The sliding block according to claim 1, wherein said first portion and said second portion are integral with one another.

7. A roller conveyor associable to an accelerator and decelerator sliding block for transport system vehicles and comprising a beam which carries a plurality of axes, each carrying in turn at least one roller associable to said sliding block, wherein first rollers, arranged at free ends of said conveyor, are projecting and more spaced from one another with respect to second rollers.

8. The roller conveyor according to claim 7, wherein each of said axes supports at least two pulleys and integral rollers, said pulleys being connected to one another in pairs, by means of driving belts.

9. The roller conveyor according to claim 7, wherein said roller conveyor is functionally symmetrical with respect to a longitudinal axis.

10. An accelerator and decelerator sliding block for transport system vehicles, comprising at least one first flat portion longitudinally elongated, operatively associable to a roller conveyor, for decelerating or accelerating said vehicle, wherein said sliding block comprises at least one second plane portion, longitudinally elongated as well, which extends for a different length with respect to said first portion, and wherein the first flat portion and the second plane portion are in a same plane.

11. The sliding block according to claim 10, wherein said second portion is placed side by side to said first portion.

12. The sliding block according to claim 11, wherein said sliding block is symmetrical with respect to a center traversal axis.

13. The sliding block according to claim 10, wherein said first portion exhibits, at longitudinal opposed ends, junction chamfers which constitute a receiving element for successive rollers of said conveyor.

14. The sliding block according to claim 10, wherein said second portion exhibits, at longitudinal opposed ends, junction chamfers which constitute a receiving element for successive rollers of said conveyor.

15. The sliding block according to claim 10, wherein said first portion and said second portion are integral with one another.

* * * * *